United States Patent [19]

Rogers

[11] Patent Number: 4,559,751

[45] Date of Patent: Dec. 24, 1985

[54] CORROSIVE RESISTANT GRID CONSTRUCTION FOR A SUSPENDED CEILING

[75] Inventor: David J. Rogers, Brampton, Canada

[73] Assignee: Crystaplex Plastics Ltd., Mississauga, Canada

[21] Appl. No.: 585,043

[22] Filed: Mar. 1, 1984

[51] Int. Cl.[4] ..... E04C 2/42

[52] U.S. Cl. ..... 52/665; 52/712; 52/741; 403/397; 403/346

[58] Field of Search ..... 52/712, 665, 484, 741, 52/489; 403/397, 346, 347

[56] References Cited

U.S. PATENT DOCUMENTS

| | | | |
|---|---|---|---|
| 3,089,569 | 5/1963 | Shults | 52/484 X |
| 3,187,854 | 6/1965 | Lydard | 403/397 X |
| 3,204,383 | 9/1965 | Adams | 52/484 X |
| 3,292,332 | 12/1966 | John | 52/484 |
| 3,304,684 | 2/1967 | Mock et al. | 52/665 |
| 3,355,206 | 11/1967 | Valsvik | 52/665 X |
| 4,408,428 | 10/1983 | Brooke et al. | 52/489 |
| 4,479,341 | 10/1984 | Schuplin | 52/665 |

FOREIGN PATENT DOCUMENTS

| | | | |
|---|---|---|---|
| 555365 | 4/1958 | Canada . | |
| 762142 | 7/1967 | Canada | 20/18 |
| 1095682 | 2/1981 | Canada | 20/18 |

*Primary Examiner*—Carl D. Friedman

*Attorney, Agent, or Firm*—Jones, Tullar & Cooper

[57] ABSTRACT

A clamp is disclosed for joining fiberglass reinforced plastic grid members in order to provide a corrosive-resistant frame work for a suspended ceiling. The grid members are of an inverted T configuration. The flanges of the cross members are cut back so that the web of each cross member rests on the flange of a support member with the flanges of the support and cross members flush. The keepers of an integrally formed stainless steel clamp extend through holes in the web of the support member on either side of the web of the cross member. The legs of the clamp straddle the web of the cross member and a cross piece of the clamp is received in a notch in the top of the web. In this position the clamp is stressed and so provides a force holding the cross member on the flange of the support member.

20 Claims, 3 Drawing Figures

CORROSIVE RESISTANT GRID CONSTRUCTION FOR A SUSPENDED CEILING

BACKGROUND OF THE INVENTION

This invention relates to a clamp to join two members and, in a particular embodiment, to a grid of joined members for a suspended ceiling which may be adapted to withstand corrosive environments.

Grids for suspended ceiling assemblies are widely known in the building construction industry. Often the grid members are of an inverted "T" configuration—a flange extending normally from either side of the base of a web. With this configuration, the flanges of the grid members will support ceiling panels. Generally, the grids comprise parallel support members with cross-members stretching between adjacent support members. Various methods have been devised to join the ends of the cross members to the support members. For example, in Canadian Pat. No. 555,365 to Fotheringham, dated Apr. 1, 1958, the ends of each cross-member are provided with a tab extention, integral with one of the flanges of the cross-member. The end of a cross-member rests on the flange of a support member with the tab received through a slot in the web of the support member. The tab is bent against the side surface of the web in order to secure the cross member in position.

In Canadian Pat. No. 1,095,682 issued Feb. 17, 1981 to Balinski, the ends of the cross-member webs are provided with tongue extensions which are received in slots in the supporting members. The cross-members are dimensioned so as to provide an expansion gap between the ends of each cross-member and the support members to which each cross-member is joined. Only the tongues extend to and beyond the flanges of the support members.

In both of these prior art patents, the grid members are metallic. While these grid constructions are satisfactory for certain applications, they are not satisfactory for use in a corrosive environment wherein metal grid members would deteriorate. Further, in order to apply the joint taught in Canadian Pat. No. 555,365 to non-corrosive grid members, a non-corrosive material would have to be found which is sufficiently malleable to allow the tab at the ends of the cross-members to be bent. Further yet, although replacing the metal grid members of Canadian Pat. No. 1,095,682 with non-corrosive members would provide a ceiling panel supporting grid construction, the grid construction would not present a satisfactory barrier to a corrosive environment due to the gaps between the cross-members and support members.

Consequently, there remains a need for a means to join grid members which may not only be used in non-corrosive environments but which may also be adapted for use in corrosive environments and which results in a low cost of construction. The present invention seeks to provide such a joint.

SUMMARY OF THE INVENTION

In one aspect, the present invention is a clamp for joining one member to a support member of the type having means to support the one member against movement in one direction, comprising: keeper means; a cross segment; an intermediate portion resiliently joining the keeper means to the cross segment; the keeper means for association with means associated with the support member so that displacement of the cross segment in a direction opposite the one direction stresses the clamp; the cross segment for displacing in the direction opposite the one direction when the keeper means is associated with the means associated with the support member and for abutting the one member opposite the means to support in order to urge the one member against the means to support.

The present invention is also a method of joining the end of at least one member to the side of another member having means to support the first mentioned member against movement in one direction comprising the steps of: associating keeper means of a clamp of the type having keeper means joined resiliently to a cross segment by an intermediate portion with means associated with the second mentioned member so that displacement of the cross segment in a direction opposite the one direction stresses the clamp; inserting the end of the first mentioned member between the means to support the first mentioned member and the cross segment of the spring thereby resiliently displacing the cross segment in the direction opposite the first direction.

BRIEF DESCRIPTION OF THE DRAWINGS

In the drawings which illustrate a preferred embodiment of the invention.

DESCRIPTION OF PREFERRED EMBODIMENT

The grid members to be joined are preferably of an inverted T-configuration comprising a web and two flanges extending normally therefrom. With this configuration, the ends of the cross-members may be placed upon, and be supported by, the flanges of the support members.

Figure 1:
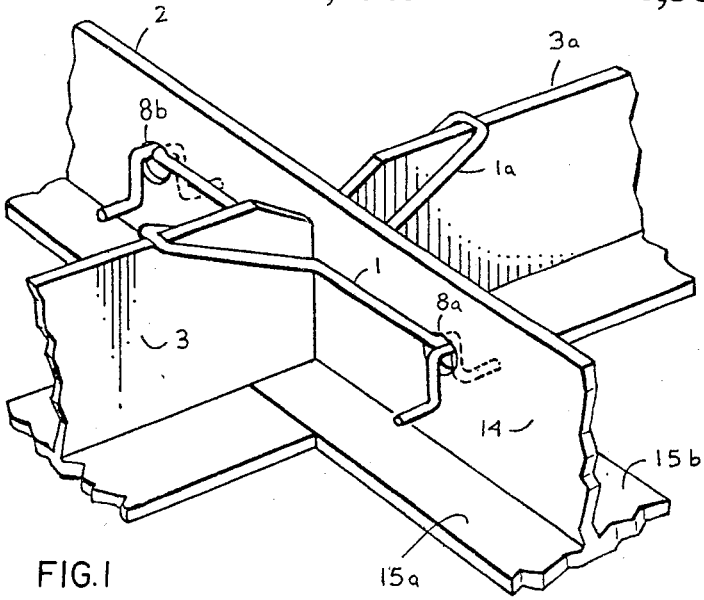
FIG. 1 is a perspective view of a portion of a grid system showing two cross-members joined to a support member by clamps.
Figure 2:
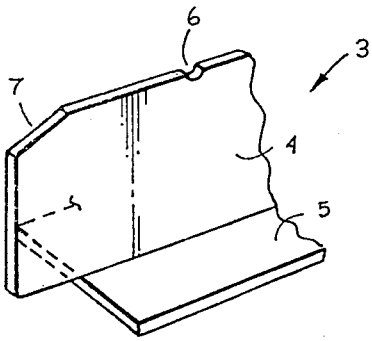
FIG. 2 is a perspective view of an end of a cross-member for use in the assembly of FIG. 1.

Other advantages of the inverted T-configuration are seen by reference to FIGS. 1 and 2. Each end of cross-member 3 has flanges 5 removed for a distance equal to the width of flange 15*a* of support member 2 so that, when one end of cross-member 3 rests on flange 15*a*, the top surface of flanges 5 and 15*a* are flush. This is a desirable feature in a ceiling grid construction where the flanges support ceiling panels. Further, as a result of this configuration, the end face of cross-member 3 may abut the side surface of support member 2. This abutting relationship is desirable in a ceiling grid construction where the ceiling is to present a barrier to the environment on one side thereof.

If other grid member configurations are employed, the support members must have means which are able to perform the function of the support member flanges in supporting the ends of the cross-members. For example, these could take the form of protrusions extending from the web of the support member.

Turning now to FIG. 1, one end of two cross-members 3 and 3*a* are shown joined by clamp 1 and 1*a* to either side of a support member 2 in accordance with this invention.

Figure 3:
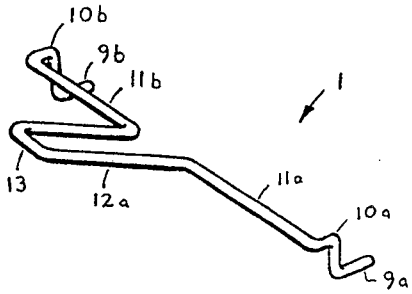
FIG. 3 is a perspective view of the clamp of FIG. 1.

The clamp 1, as seen by reference to FIG. 3, comprises a cross segment 13 joined by an intermediate portion, namely arms 12 and legs 11, to keepers 10. Feet 9 extend beyond the keepers. It is preferred that the clamp be integrally formed of a resilient material. At the very least the intermediate portion must resiliently join the keepers to the cross segment.

Referring again to FIG. 1 and considering only the joint between cross-member 3 and support member 2, it is seen that the bottom surface of one end of web 4 (FIG. 2) of cross-member 3 is supported against movement in one direction by flange 15*a* of support member 2. Keepers 10 of clamp 1 extend through openings 8 in support member 2 and along the side of web 14 opposite cross-member 3. Segment 13 overlies the top surface of web 4 of cross-member 3. The clamp is configured so that it is deformed from its rest position and under stress in this position. Thus, cross segment 13 of the clamp forceably contacts the top surface of web 4 and urges the cross-member against flange 15*a*.

This arrangement restrains cross-member 3 from movement in either direction perpendicular to both the longitudinal axes of the cross-member 3 and support member 2. Further, the frictional engagement between segment 13 and the top surface of web 4 assists in restraining the cross-member from movement in a direction parallel to the longitudinal axis of the cross-member. This latter-mentioned restraint may be augmented by the provision of a notch 6 (FIG. 2) in the top surface of web 4 which receives segment 13 of clamp 1. Further web 14 restrains the cross-member 3 from movement in one direction parallel to the longitudinal axis of the cross-member as the notch is positioned so that the end face of web 4 abuts the side of web 4 when segment 13 is received by the notch.

In order to restrain the cross-member from movement in a direction parallel to the longitudinal axis of the support member, clamp 1 is configured such that arms 12 lie adjacent the sides of web 4 when the clamp is in the position illustrated in FIG. 1.

Clearly, these features of the joint co-operate to restrain the cross-member from movement in any direction.

In a particular preferred embodiment, arms 12 incorporate a medial bend so that the portions of arms 12 between the band and segment 13 are inclined at a greater angle from the plane containing feet 9 than the portion of arms 12 between the bend and legs 11. This configuration of the clamp increases the restraint of cross-member 3 from movement in the longitudinal axis of the cross-member and from movement parallel to the longitudinal axis of support member 2.

If other grid member configurations are utilized, the means performing the function of flange 15 in supporting the cross-member against movement in one direction may support the cross-member against movement in any one direction. The clamp may need to be somewhat differently configured so that segment 13 will engage the diametrically opposite side of the cross-member and urge the cross-member against this supporting means.

While openings 8 are the preferred means of receiving keepers 10, other means may be employed. For example, by modifying the FIG. 3 configuration of clamp 1 so that feet 9 (whose function is described hereinafter) are directed opposite the direction shown in FIG. 3, each keeper 10 of clamp 1 may be affixed to the side of web 14 adjacent cross-member 3 by a clamp.

In order to facilitate assembly of the joint of FIG. 1, it is preferred that the ends of the top surfaces of web 4 are chamfered as at 7 (FIG. 2).

The described joint will withstand corrosive environments if the clamp and the grid members are formed of corrosive resistent materials. To this end the clamp may be formed of stainless steel and the support members and cross-members of fiberglass reinforced plastic.

As illustrated in FIG. 1, openings 8 may be sized to accept keepers 10 of two clamps 1 and 1*a*. This allows the two clamps to be operatively positioned back to back on either side of the support member 2 in order that cross-members may be joined to either side of the support member. With the keepers of two clamps passing through an opening 8, the keeper of one clamp occupies the portion of the opening proximate the cross-members leaving the portion of openings 8 remote from the cross-members for the keeper of the other clamp. This arrangement will result in a slight spreading of the other clamp.

To form a grid of members joined in accordance with this invention, a plurality of support members may be arranged in parallel with cross-members running between adjacent support members and the joints shown in FIG. 1 repeated at each intersection between a cross-member and a support member.

When the joint described is employed in a ceiling grid assembly, optional clamp feet 9 may overlie the ceiling panels and maintain the panels in place atop the flanges of the grid members. This feature, together with the feature of the end face of each cross-member abutting the side of its support member, results in the ceiling acting as a barrier to an environement.

It is preferred that, for a ceiling grid assembly, a set of openings 8 be provided every 24 inches along the length of the support members. The grid may be suspended by means of wires passing through holes (not shown) provided in the support members. These holes may be located every 12 inches along the length of the support member. For a ceiling grid assembly where the grid members are of fiberglass reinforced plastic, it is preferred that the support members by 12′ in length and the cross-members 4′ in length. If the support members are to span more than 12′, a stainless steel U-clamp bolts two support members together end to end. Where the grid system meets a wall, an L-shaped support member is used, the web of the L being adjacent the wall and the flange supporting cross-members. Joints between a cross-member and the L-shaped support member are formed as before save that clamps are only provided on the flange side of the L-shaped support member and the clamps do not have feet 9.

In order to assemble the aforedescribed joint between support member 2 and cross-member 3, the free ends of clamp 1 are inserted through one side of openings 8*a* and 8*b* of support member 2. The clamp is then manipulated so that keepers 10 are disposed through the openings and adjacent one side of the web 14 of support member 2. In this position, the clamp is "right side up" if segment 13 is a greater vertical distance from flange 15*a* than legs 11.

Next one end of web 4 of cross-member 3 is inserted between cross segment 13 of clamp 1 and flange 15*a*. As cross-member 3 is inserted, chamber 7 contacts segment 13 of clamp 1 and displaces same away from flange 15*a* thereby resiliently deforming the clamp. The cross-member is inserted until segment 13 of the clamp snaps into notch 6. In this position the end face of the cross-member abuts the side web 14 and flange 15*a*.

After completing the joint between cross-member 3 and support member 2, a joint between cross-member 3*a* and support member 2 may be formed. To do so the free ends of clamp 1*a* are slightly spread and then inserted through openings 8*a* and 8*b* from the side opposite to that from which clamp 1 was inserted. Clamp 1*a* is then manipulated so that keepers 10 are disposed through openings 8 and along the other side of web 14. So long as clamp 1*a* is "right side up", cross-member 3*a* may be inserted between segment 13 of the clamp and web 15*b* until segment 13 snaps into notch 6.

To form a grid system, this procedure repeated at each pair of openings along the length of a plurality of parallel support members so that the ends of each cross-member are joined to adjacent support members.

When feet 9 are present, these overlie the ceiling panels in order to maintain them in position. A ceiling panel so overlain may be removed by applying upward pressure at its center so that the panel deforms and pops out from underneath feet 9.

Grid members of fiberglass reinforced plastic may be formed by pultruding. Openings 8 and the holes through which the wires pass to suspend the ceiling may be drilled in the support members. Chamber 7 may be machined, and the end of the flanges of the cross-members may also be removed in this way.

The embodiments of the invention in which an exclusive property or privilege is claimed are defined as follows:

1. For a suspended ceiling assembly comprising a grid of parallel supporting members and cross-members extending between adjacent supporting members, said supporting members having means to support cross-members against movement in one direction, a clamp for joining a cross-member to a supporting member, comprising:

(a) two keepers;

(b) a cross segment;

(c) an intermediate portion resiliently joining said two keepers to said cross segment;

said two keepers being disposed for association with two openings in said supporting member, each opening for receiving a portion of one of said keepers, and a side of said supporting member for abutting another portion of each of said keepers so that movement of said cross segment in a direction opposite said one direction stresses said clamp;

said cross segment for moving in said direction opposite said one direction when said keepers are associated with said two openings in said supporting member and said side of said supporting member and for abutting said cross-member opposite said means to supporting order to urge said cross-member against said means to support.

2. The clamp of claim 1 wherein said means to support said cross-member against movement in one direction comprises a flange extending from said supporting member.

3. The clamp of claim 1 wherein said intermediate portion includes two bent arms for lying adjacent either side of said one member.

4. The clamp of claim 1 wherein each said keeper has an integrally formed foot for overlying ceiling panels supported by said grid members.

5. The clamp of claim 1 wherein said intermediate portion includes two arms for extending adjacent either side of said cross-member.

6. The clamp of claim 1 wherein said intermediate portion is integrally formed with said cross segment and said two keepers.

7. The clamp of claim 1 wherein said grid members are of a material which withstands corrosive environments.

8. The clamp of claim 1 wherein said grid members are formed of fiberglass reinforced plastic.

9. The clamp of claim 1 wherein said clamp is integrally formed and made of stainless steel.

10. For a suspended ceiling assembly comprising a grid of parallel supporting members and cross-members extending between adjacent supporting members, said supporting members and said cross-members having a generally T-shaped cross sectional configuration providing a vertically extending web with two flanges at the lower end of said web extending substantially normally thereto, the flanges of said supporting members supporting said cross-members against movement in one direction, a clamp for joining a cross-member to a supporting member, comprising:

(a) keeper means;

(b) a cross segment;

(c) an intermediate portion resiliently joining said keeper means to said cross segment said keeper means being disposed for association with means associated with said supporting member so that movement of said cross segment in a direction opposite said one direction stresses said clamp;

said cross segment for moving in said direction opposite said one direction when said keeper means is associated with said means associated with said supporting member and for abutting said cross-member opposite one of the flanges of said supporting member in order to urge said cross-member against said flange of said supporting member.

11. The clamp of claim 10 wherein the end portions of the flanges of said cross-members are removed to a distance equivalent to the width of a flange of said supporting members.

12. The clamp of claim 11 wherein the top surface of the web of each cross-member contains a notch proximate each end of the cross-member into which the cross segment of two said clamps may be received.

13. The method of joining the end of at least one member to the side of another member having means to support the first mentioned member against movement in one direction, comprising the steps of:

(a) associating keeper means of a clamp of the type having keeper means joined resiliently to a cross segment by an intermediate portion with means associated with said second mentioned member so that displacement of said cross segment in a direction opposite said one direction stresses said clamp;

(b) inserting said end of said first mentioned member between said means to support the first mentioned member and said cross segment of said clamp thereby resiliently displacing said cross segment in said direction opposite said first direction.

14. The method of claim 13 wherein the means to support the first mentioned member against movement in one direction comprises a flange extending from said second mentioned member.

15. The method of joining the end of at least one longitudinally extending member to the side of another longitudinally extended member having a flange to support the first mentioned member against movement in one direction, comprising the steps of:

(a) inserting the keepers of a clamp of the type having two keepers, a cross segment and an intermediate portion resiliently joining said keepers to said cross segment through openings in said second mentioned member;

(b) manipulating said clamp so that a portion of said keepers lie adjacent a side of said second mentioned member and co-operate with a portion of said keepers extending through said openings so that movement of said cross segment in a direction opposite said one direction stresses said clamp;

(c) inserting said end of said first mentioned member between said flange to support the first mentioned member and said cross segment of said clamp thereby resiliently displacing said cross segment of said clamp in said direction opposite said one direction and stressing said clamp.

16. The method of claim 15 including the step of:

(d) continuing to insert said end until the cross segment of said clamp snaps into a notch provided in said first mentioned member.

17. The method of claim 16 including the step of:

(e) inserting the keepers of a second clamp of the type having two keepers, a cross segment and an intermediate portion integrally joining said keepers to said cross segment through said openings in said second mentioned member from the side of said second mentioned opposite said first mentioned member;

(f) manipulating said second clamp so that a portion of said keepers lie adjacent the side of said second mentioned member which is proximate said first mentioned member and co-operate with a portion of said keepers extending through said openings so that movement of said cross segment of said second clamp in a direction opposite said one direction stresses said clamp;

(g) inserting the end of a longitudinally extended member between means associated with said second mentioned longitudinally extended member for supporting said third mentioned longitudinally extended member against movement in said one direction and said cross segment of said second clamp thereby displacing said cross segment of said second clamp in said direction opposite said one direction and stressing said second clamp.

18. The method of claim 16 wherein the second mentioned longitudinally extending member is one of a plurality of parallel support members and the first mentioned longitudinally extending member is one of a plurality of cross-members stretching between adjacent support members which, when joined, form a grid of members for use in supporting ceiling panels in a suspended ceiling assembly.

19. The method of claim 15 wherein the members and the clamp are made of a corrosion-resistant material.

20. The method of claim 15 wherein the members are made of fiberglass reinforced plastic and the clamp is integrally formed and made of stainless steel.

* * * * *